US008091687B2

(12) United States Patent
Hamaji

(10) Patent No.: US 8,091,687 B2
(45) Date of Patent: Jan. 10, 2012

(54) ELEVATOR SYSTEM

(75) Inventor: Hiroaki Hamaji, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 482 days.

(21) Appl. No.: 12/444,769

(22) PCT Filed: Oct. 25, 2006

(86) PCT No.: PCT/JP2006/321266

§ 371 (c)(1),
(2), (4) Date: Apr. 8, 2009

(87) PCT Pub. No.: WO2008/050416

PCT Pub. Date: May 2, 2008

(65) Prior Publication Data

US 2010/0006379 A1 Jan. 14, 2010

(51) Int. Cl.
*B66B 1/20* (2006.01)

(52) U.S. Cl. ..... 187/384; 187/392

(58) Field of Classification Search ..... 187/247, 187/248, 380–389, 391–393, 396
See application file for complete search history.

(56) References Cited

U.S. PATENT DOCUMENTS

| | | | | |
|---|---|---|---|---|
| 7,093,693 | B1 * | 8/2006 | Gazdzinski | 187/384 |
| 7,328,775 | B2 * | 2/2008 | Zaharia et al. | 187/396 |
| 7,717,238 | B2 * | 5/2010 | Hamaji et al. | 187/396 |
| 7,793,762 | B2 * | 9/2010 | Zaharia et al. | 187/396 |
| 7,849,974 | B2 * | 12/2010 | Stanley et al. | 187/387 |
| 2002/0023804 | A1 * | 2/2002 | Pfeffer | 187/384 |
| 2010/0219025 | A1 * | 9/2010 | Laihanen et al. | 187/387 |

FOREIGN PATENT DOCUMENTS

| | | |
|---|---|---|
| JP | 7 108751 | 11/1995 |
| JP | 2002 220162 | 8/2002 |
| JP | 2002 348053 | 12/2002 |
| JP | 2003 276958 | 10/2003 |
| JP | 2005 170529 | 6/2005 |
| JP | 2005 170541 | 6/2005 |
| JP | 2005 255320 | 9/2005 |
| JP | 2006 16124 | 1/2006 |

* cited by examiner

*Primary Examiner* — Anthony Salata
(74) *Attorney, Agent, or Firm* — Oblon, Spivak, McClelland, Maier & Neustadt, L.L.P.

(57) ABSTRACT

In an elevator system, an operation of a car is controlled by an operation control section. When a specific user in the car is certified by personal authentication of a personal authentication section after a landing call registration operation is performed by a user through a landing call operation section provided on a landing, the operation control section counts registered specific floors present in a traveling direction of the car according to the landing call registration operation in the registered specific floors based on registered floor information received from the personal authentication section, and performs a destination floor registration with the registered specific floor being a destination floor of the car if the number of the counted registered specific floors is one.

20 Claims, 14 Drawing Sheets

FIG. 13

| TIME ZONE | AUTOMATIC REGISTRATION | |
|---|---|---|
| | EFFECTIVE | INEFFECTIVE |
| 00:00～01:00 | | ○ |
| 01:00～02:00 | | ○ |
| 02:00～03:00 | | ○ |
| 03:00～04:00 | | ○ |
| 04:00～05:00 | | ○ |
| 05:00～06:00 | | ○ |
| 06:00～07:00 | | ○ |
| 07:00～08:00 | ○ | |
| 08:00～09:00 | ○ | |
| 09:00～10:00 | ○ | |
| 10:00～11:00 | | ○ |
| 11:00～12:00 | | ○ |

| TIME ZONE | AUTOMATIC REGISTRATION | |
|---|---|---|
| | EFFECTIVE | INEFFECTIVE |
| 12:00～13:00 | | ○ |
| 13:00～14:00 | | ○ |
| 14:00～15:00 | | ○ |
| 15:00～16:00 | ○ | |
| 16:00～17:00 | ○ | |
| 17:00～18:00 | ○ | |
| 18:00～19:00 | | ○ |
| 19:00～20:00 | | ○ |
| 20:00～21:00 | | ○ |
| 21:00～22:00 | | ○ |
| 22:00～23:00 | | ○ |
| 23:00～00:00 | | ○ |

FIG. 14

| RESIDENT | | AUTOMATIC REGISTRATION | |
|---|---|---|---|
| ROOM NUMBER | FAMILY NUMBER | EFFECTIVE | INEFFECTIVE |
| 201 | 001 | | ○ |
| 201 | 002 | | ○ |
| 202 | 001 | | ○ |
| 202 | 002 | ○ | |
| 203 | 001 | | ○ |
| ... | ... | ... | ... |
| 505 | 001 | ○ | |
| 505 | 002 | | ○ |

FIG. 15

| FLOOR NAME | AUTOMATIC REGISTRATION | |
|---|---|---|
| | EFFECTIVE | INEFFECTIVE |
| 1 | ○ | |
| B1 | | ○ |
| B2 | | ○ |

ELEVATOR SYSTEM

TECHNICAL FIELD

The present invention relates to an elevator system providing predetermined elevator service to a specific user certified by personal authentication, which is used for a building such as collective housing with, for example, a built-in home automation system.

BACKGROUND ART

In a conventional call registration apparatus of an elevator, personal authentication of a specific user is made by fingerprint matching to permit a destination floor registration operation of a car for a specific floor, which is performed by the specific user certified by the personal authentication (for example, see Patent Document 1).

Patent Document 1: JP 2002-220162 A

DISCLOSURE OF THE INVENTION

Problem to be Solved by the Invention

With the conventional call registration apparatus of the elevator as described above, it is necessary to perform a plurality of operations, specifically, a fingerprint matching operation and the destination floor registration operation for the car to allow the specific user to move to the specific floor. Therefore, for example, when the specific user comes back to his/her residence on the specific floor, the specific user is required to perform the fingerprint matching operation and the destination floor registration operation for the car even if there exists only one specific floor on which the specific user can ride on or off the elevator. As a result, convenience for the specific user decreases.

The present invention has been made to solve the problem as described above, and has an object of obtaining an elevator system capable of improving the convenience for the specific user certified by the personal authentication to move to the specific floor.

Means for Solving the Problem

According to the present invention, there is provided an elevator system used for a building including a plurality of specific floors usable by a specific user acquiring personal identification information in advance, including: an operation control section for controlling an operation of a car; an intra-car input section provided in the car, to which the personal identification information is input by the specific user; a personal authentication section for making personal authentication of the specific user based on the personal identification information received from the intra-car input section; and a registered information extracting section capable of being registered with information of a registered specific floor corresponding to the specific floor pre-designated by the specific user as registered floor information in association with the personal identification information, for extracting the registered floor information corresponding to the specific user certified by the personal authentication based on the personal identification information received from the personal authentication section, in which, upon the personal authentication of the specific user in the car by the personal authentication section while the operation control section causes the car to wait on a landing in response to a landing call registration operation performed on the landing, the operation control section counts the registered specific floors present in a traveling direction of the car according to the landing call registration operation in the registered specific floors based on the registered floor information received from the registered information extracting section, and performs a destination floor registration with the registered specific floor being a destination floor of the car if the number of the counted registered specific floors is one.

BRIEF DESCRIPTION OF THE DRAWINGS

[FIG. 13] An explanatory view for illustrating an example of an operating condition of an elevator controller according to a tenth embodiment of the present invention.

[FIG. 14] An explanatory view for illustrating another example of the operating condition of the elevator controller according to the tenth embodiment of the present invention.

[FIG. 15] An explanatory view for illustrating a further example of the operating condition of the elevator controller according to the tenth embodiment of the present invention.

BEST MODE FOR CARRYING OUT THE INVENTION

Figure 1:
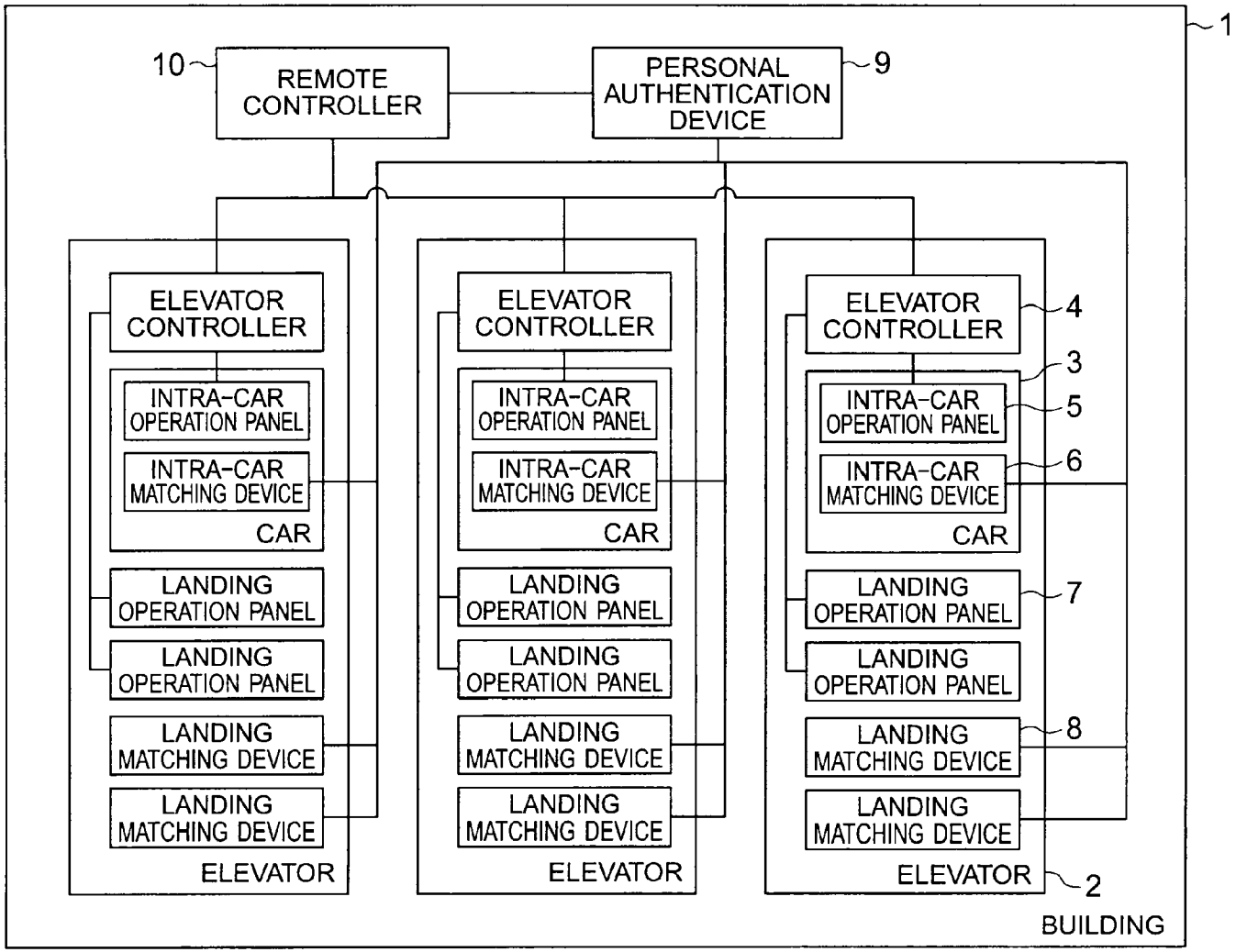
[FIG. 1] A block diagram illustrating an elevator system according to a first embodiment of the present invention.

Hereinafter, preferred embodiments of the present invention are described referring to the drawings.

First Embodiment

FIG. 1 is a block diagram illustrating an elevator system according to a first embodiment of the present invention. In FIG. 1, a building 1 includes a general floor usable by an unspecified number of general users and a plurality of specific floors, each being usable by a specific user who obtains permission to access the specific floor in advance. In the building 1, a plurality of elevators 2 are provided. A unique elevator car number is assigned to each of the elevators 2. Each of the elevators 2 includes a car 3 which is raised and lowered in a hoistway and an elevator controller 4 corresponding to an operation control section for controlling an operation of the car 3.

In the car 3 of each of the elevators 2, there are provided an intra-car operation panel (intra-car destination floor call button) 5 corresponding to an intra-car operation section operated by the user and an intra-car matching device 6 corresponding to an intra-car input section to which personal identification information is input by the specific user. The intra-car operation panel 5 notifies the elevator controller 4 of a destination floor registration operation performed by the user. For each of a plurality of landings on each floor of the building 1, there are provided a landing operation panel (landing button) 7 corresponding to a landing call operation section through which a landing call registration operation is performed by the specific user and a landing matching device 8 corresponding to a landing input section to which the personal identification information is input by the specific user. The landing operation panel 7 notifies the elevator controller 4 of a landing registration operation performed by the user.

Each of the intra-car matching device 6 and the landing matching device 8 includes a personal identification information reading section (not shown). The personal identification information reading section is, for example, an ID card reading section for reading an ID card such as a magnetic card or an IC card possessed by the specific user. The intra-car matching device 6 and the landing matching device 8 are connected to a personal authentication device 9 in which the personal identification information of the user is pre-registered.

The personal authentication device 9 makes personal authentication of the specific user based on the personal identification information received from the intra-car matching device 6 or the landing matching device 8. Upon reception of the personal identification information of the specific user, the personal authentication device 9 identifies the intra-car matching device 6 or the landing matching device 8 from which the personal identification information is input. Specifically, upon reception of the personal identification information from the landing matching device 8, the personal authentication device 9 specifies a landing floor on which the landing matching device 8 is provided. Further, by identifying an input source of the personal identification information, the personal authentication device 9 generates input position specifying information for specifying a position at which the personal identification information is input by the specific user.

When the input source of the personal identification information is the intra-car matching device 6, the input position specifying information generated by the personal authentication device 9 contains information of the elevator car number of the elevator 2 and information indicating that the input source of the personal identification information is present in the car 3. On the other hand, when the input source of the personal identification information is the landing matching device 8, the input position specifying information generated by the personal authentication device 9 contains information of the elevator car number of the elevator 2 and information indicating a landing floor on which the landing matching device 8 corresponding to the input source is located.

A remote controller 10 corresponding to a registered information extracting section is connected to the personal authentication device 9. The personal identification information of the specific user who is certified by the personal authentication of the personal authentication device 9 and the input position specifying information corresponding to the specific user are transmitted from the personal authentication device 9 to the remote controller 10. In the remote controller 10, information of a plurality of registered floors registered by the specific user in advance is pre-registered as registered floor information in association with the personal identification information. The registered floor information contains a registered general floor which is a general floor registered by the specific user in advance and a registered specific floor which is a specific floor registered by the specific user in advance.

The remote controller 10 extracts the registered floor information corresponding to the specific user certified by the personal authentication based on the personal identification information received from the personal authentication device 9. The remote controller 10 transmits the registered floor information and the input position specifying information as authentication content information to the elevator controller 4 of the elevator 2 having the elevator car number based on the input position specifying information transmitted from the personal authentication device 9. Specifically, the personal authentication device 9 and the remote controller 10 constitute a personal authentication section.

Figure 2:
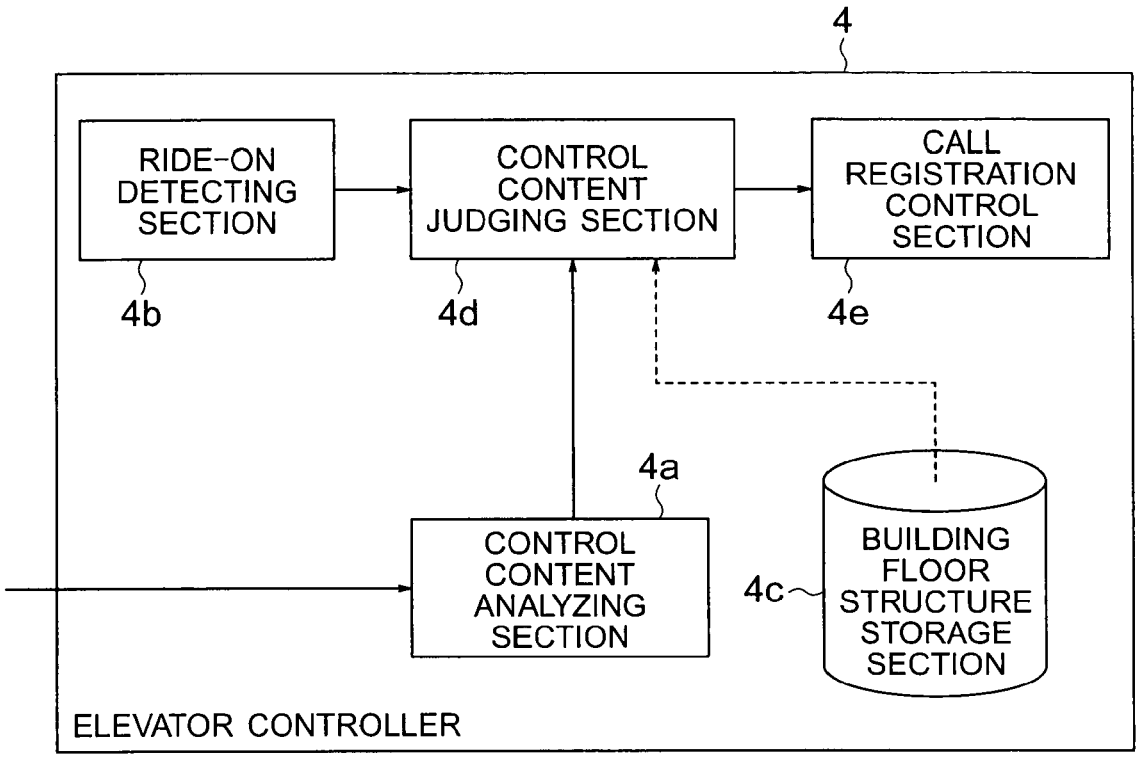
[FIG. 2] A block diagram illustrating an elevator controller illustrated in FIG. 1 in a specific manner.

FIG. 2 is a block diagram illustrating the elevator controller 4 illustrated in FIG. 1 in a specific manner. The elevator controller 4 includes a control content analyzing section 4*a*, a ride-on detecting section 4*b*, a building floor structure storage section (general floor/specific floor table) 4*c*, a control content judging section 4*d*, and a call registration control section 4*e*. The control content analyzing section 4*a* analyzes the authentication content information received from the remote controller 10. Moreover, the control content analyzing section 4*a* analyzes the authentication content information to verify contents of the registered floor information and the input position specifying information corresponding to the specific user certified by the personal authentication.

The ride-on detecting section 4*b* monitors outputs from, for example, a photoelectric sensor (not shown) provided in the car 3, a load detecting device (not shown) for detecting a load on the car 3, and a surface pressure sensor (not shown) provided on a floor surface of the car 3 and the like to detect a ride of the user on/off the car 3. The building floor structure storage section 4*c* is pre-registered with building floor structure information which is information indicating that each of the floors of the building is the general floor or the specific floor.

The control content judging section 4*d* judges how the operation of the car 3 is to be controlled based on the information of the contents analyzed by the control content analyzing section 4*a*, the building floor structure information in the building floor structure storage section 4*c*, a ride status of the user in the car 3, and the registration operations performed by the user, specifically, the destination floor registration operation and the landing call registration operation.

Here, an example of the contents of control of the car 3, which are judged by the control content judging section 4*d*, is specifically described. In response to the landing call registration operation performed through the landing operation panel 7 by the user, the control content judging section 4*d* causes the car 3 to wait on the landing floor on which the operated landing operation panel 7 is located. At this time, when the control content analyzing section 4*a* analyzes that the personal authentication device 9 makes personal authentication of the specific user in the car 3, the control content judging section 4*d* counts the registered specific floors present in a traveling direction of the car 3 according to the landing call registration operation in the registered specific floors corresponding to the specific user certified by the personal authentication based on the building floor structure information. When the number of the counted registered specific floors is one, the control content judging section 4*d* performs a destination floor registration with the registered specific floor being a destination floor of the car 3.

The call registration control section 4*e* performs an elevator call registration (automatic registration of an elevator call) corresponding to a destination floor registration and a landing call registration based on the contents of control judged by the control content judging section 4*d*. The call registration control section 4*e* also disables the destination floor registration operation for all the specific floors, which is performed by the user through the intra-car operation panel 5. Further, the call registration control section 4*e* permits the destination floor registration operation for the registered specific floor, which is performed by the user through the intra-car operation panel 5, based on the contents of control judged by the control content judging section 4*d*.

Here, each of the elevator controller 4, the personal authentication device 9 and the remote controller 10 can be constituted by a computer (not shown) including an arithmetic processing unit (CPU), a storage section (a ROM, a RAM, a hard disk and the like) and a signal input/output section. In the storage section of the computer of the elevator controller 4, programs for realizing the functions of the control content analyzing section 4*a*, the ride-on detecting section 4*b*, the control content judging section 4*d* and the call registration control section 4*e* are stored. A program for realizing the operation of the personal authentication device 9 is stored in the storage section of the computer of the personal authentication device 9. A program for realizing the operation of the remote controller 10 is stored in the storage section of the computer of the remote controller 10.

Figure 3:
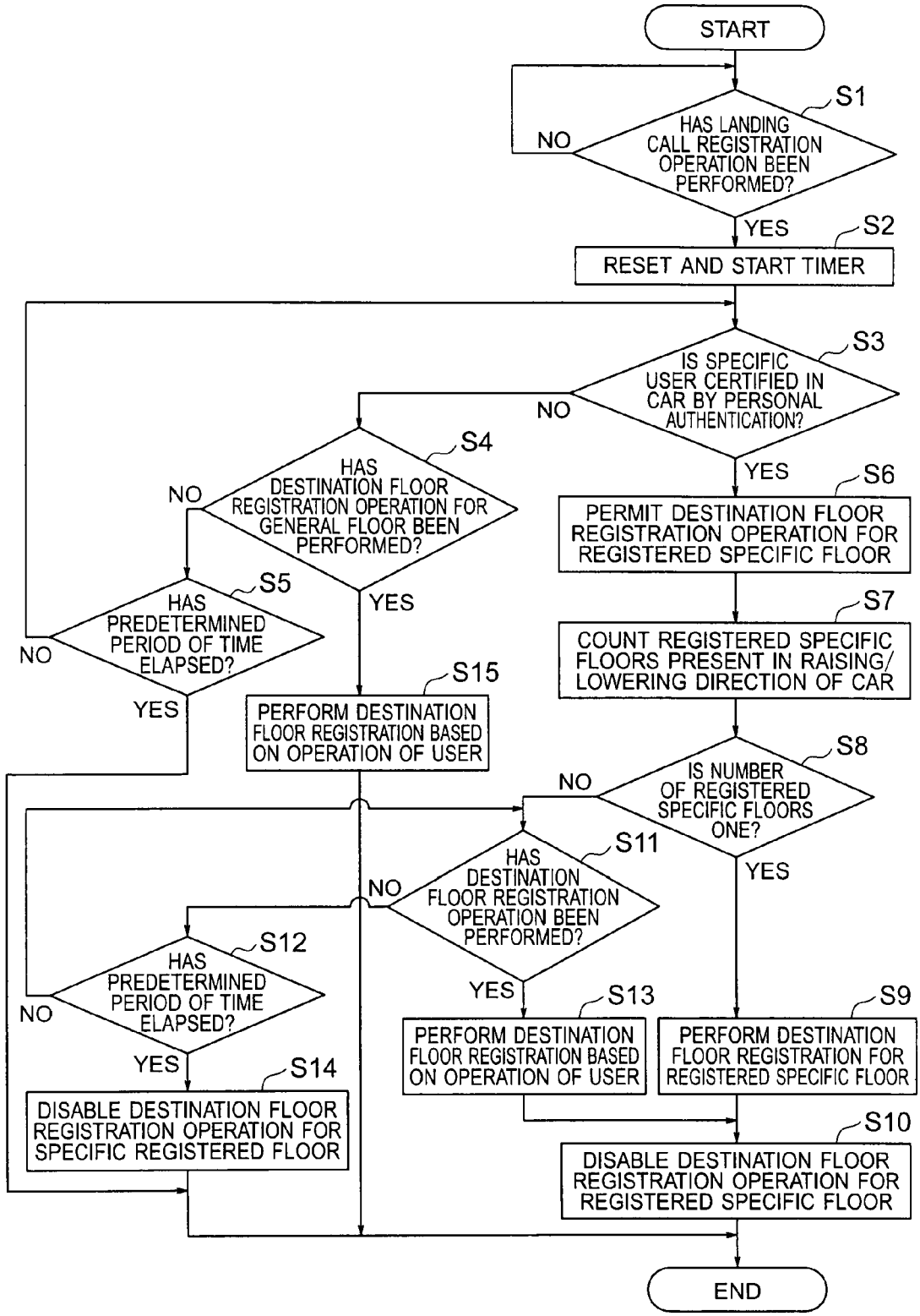
[FIG. 3] A flowchart illustrating an operation of the elevator controller illustrated in FIG. 1.

Next, an operation is described. Here, an operation of the elevator controller 4 in response to the landing call registration operation is described. FIG. 3 is a flowchart illustrating the operation of the elevator controller 4 illustrated in FIG. 1. In FIG. 3, the elevator controller 4 verifies whether or not the landing call registration has been performed by the user through the landing operation panel 7 and waits until the landing call registration is performed (Step S1). When the landing call registration is performed, the elevator controller 4 raises or lowers the car 3 to the landing floor on which the landing call registration is performed. Upon detection of the arrival of the car 3 at the floor, the elevator controller 4 opens a door of the car 3, and, at the same time, resets and starts a timer (Step S2).

Then, the elevator controller 4 verifies whether or not the specific user is certified in the car 3 by the personal authentication (Step S3), and, at the same time, verifies whether or not the destination floor registration operation for the general floor has been performed by the user through the intra-car operation panel 5 (Step S3). Then, the elevator controller 4 waits until a predetermined period of time (for example, 15 seconds) elapses from the start of the timer (Step S5). When the elevator controller 4 verifies that the specific user is certified in the car 3 by the personal authentication (direction YES from Step S3), the elevator controller 4 permits the destination floor registration operation for the registered specific floor corresponding to the specific user who is certified by the personal authentication of the personal authentication device 9 (Step S6), and counts the registered specific floors present in a raising/lowering direction of the car 3 (Step S7). Then, the elevator controller 4 verifies whether or not the number of the counted registered specific floors is one (Step S8).

When the number of the counted registered specific floors is one (direction YES from Step S8), the elevator controller 4performs the destination floor registration with the registered specific floor being the destination floor of the car 3 (Step S9), and sets to disable the destination floor registration operation for the registered specific floor, which is performed through the intra-car operation panel 5 (Step S10). Then, the elevator controller 4 closes the door of the car 3 and causes the car 3 to start running to the destination floor. In this manner, the operation of the elevator controller 4 in response to the landing call registration operation is terminated.

On the other hand, when the number of the counted registered specific floors is not one (direction NO from Step S8), the elevator controller 4 verifies whether or not the destination floor registration operation for the general floor or the specific floor has been performed by the user (Step S11), and waits until the destination floor registration operation is performed by the user or a predetermined period of time elapses from the start of the timer (Step S12). Then, when the destination floor registration operation is performed by the user through the intra-car operation panel 5, the elevator controller 4 performs the destination floor registration with the general floor or the specific floor registered by the operation of the user being the destination floor of the car 3 (Step S13), and sets to disable the destination floor registration operation for the registered specific floor, which is performed through the intra-car operation panel 5 (Step S10). Then, the elevator controller 4 closes the door of the car 3 and causes the car 3 to start running to the destination floor. In this manner, the operation of the elevator controller 4 in response to the landing call registration operation is terminated.

When the elevator controller 4 verifies that the predetermined period of time has elapsed while verifying whether or not the destination floor registration operation is performed by the user or the predetermined period of time elapses from the start of the timer (direction YES from Step S12), the elevator controller 4 sets to disable the destination floor registration operation for the registered specific floor, which is performed through the intra-car operation panel 5 (Step S14), and closes the door of the car 3 to be in an operation standby state for the car 3. In this manner, the operation of the elevator controller 4 in response to the landing call registration operation is terminated.

Further, when the destination floor registration operation for the general floor is performed while the elevator controller 4 is verifying that the registered specific floor information has been received from the remote controller 10 or the destination floor registration operation for the general floor has been performed through the intra-car operation panel 5 (direction YES from Step S4), the elevator controller 4 performs the destination floor registration in response to the destination floor registration operation performed by the user through the intra-car operation panel 5 (Step S15), and closes the door of the car 3 to cause the car 3 to start running to the destination floor. In this manner, the operation of the elevator controller 4 in response to the landing call registration operation is terminated.

Further, the elevator controller 4 verifies that the predetermined period of time has elapsed while verifying whether or not the registered specific floor information has been received from the remote controller 10, the destination floor registration operation for the general floor has been performed through the intra-car operation panel 5, or the predetermined period of time has elapsed from the start of the timer (direction YES from Step S5), the elevator controller 4 closes the door of the car 3 to be in the operation standby state for the car 3. In this manner, the operation of the elevator controller 4 in response to the landing call registration operation is terminated.

In the elevator system as described above, the specific user in the car 3 is certified by the personal authentication. As a result, the registered specific floors present in the traveling direction of the car 3 in the registered specific floors registered in advance by the specific user is counted. If the number of the counted registered specific floors is one, the destination floor registration is performed with the registered specific floor being the destination floor of the car. Therefore, the destination registration operation performed by the specific user is omitted. As a result, the specific user certified by the personal authentication can easily move to the registered specific floor to improve the convenience for the specific user certified by the personal authentication to move to the specific floor.

Moreover, the destination floor registration operation for all the specific floors, which is performed by the user through the intra-car operation panel 5, is inhibited. The personal authentication of the specific user in the car 3 permits the destination registration operation for the registered specific floor corresponding to the specific user, and hence the travel of the general user to the specific floors is restricted. As a result, security on the specific floors can be improved. Specifically, the elevator system as described above can improve the convenience for the specific user while maintaining the security on the specific floors.

Second Embodiment

Next, a second embodiment of the present invention is described. The elevator controller 4 according to the first embodiment permits the destination floor registration operation for the registered specific floor, which is performed by the specific user through the intra-car operation panel 5, upon personal authentication of the specific user by the personal authentication device 9. On the other hand, the elevator controller 4 according to the second embodiment permits the destination floor registration operation for all the specific floors, which is performed by the specific user through the intra-car operation panel 5, upon personal authentication of the specific user by the personal authentication device 9. The other structure is the same as that of the first embodiment.

Next, the operation is described. The elevator controller 4 according to the second embodiment differs from the elevator controller 4 according to the first embodiment in the operation of the call elevator controller 4 according to the first embodiment for permitting the destination floor registration operation for the registered specific floor corresponding to the specific user who is certified by the personal authentication of the personal authentication device 9 upon reception of the registered floor information of the specific user (Step S6 illustrated in FIG. 3). In addition to the difference in the operation described above, the operation of the call elevator controller 4 according to the first embodiment for disabling the destination registration operation for the registered specific floor (Steps S10 and S14 illustrated in FIG. 3) is different. Here, only the differences from the first embodiment are described.

Figure 4:
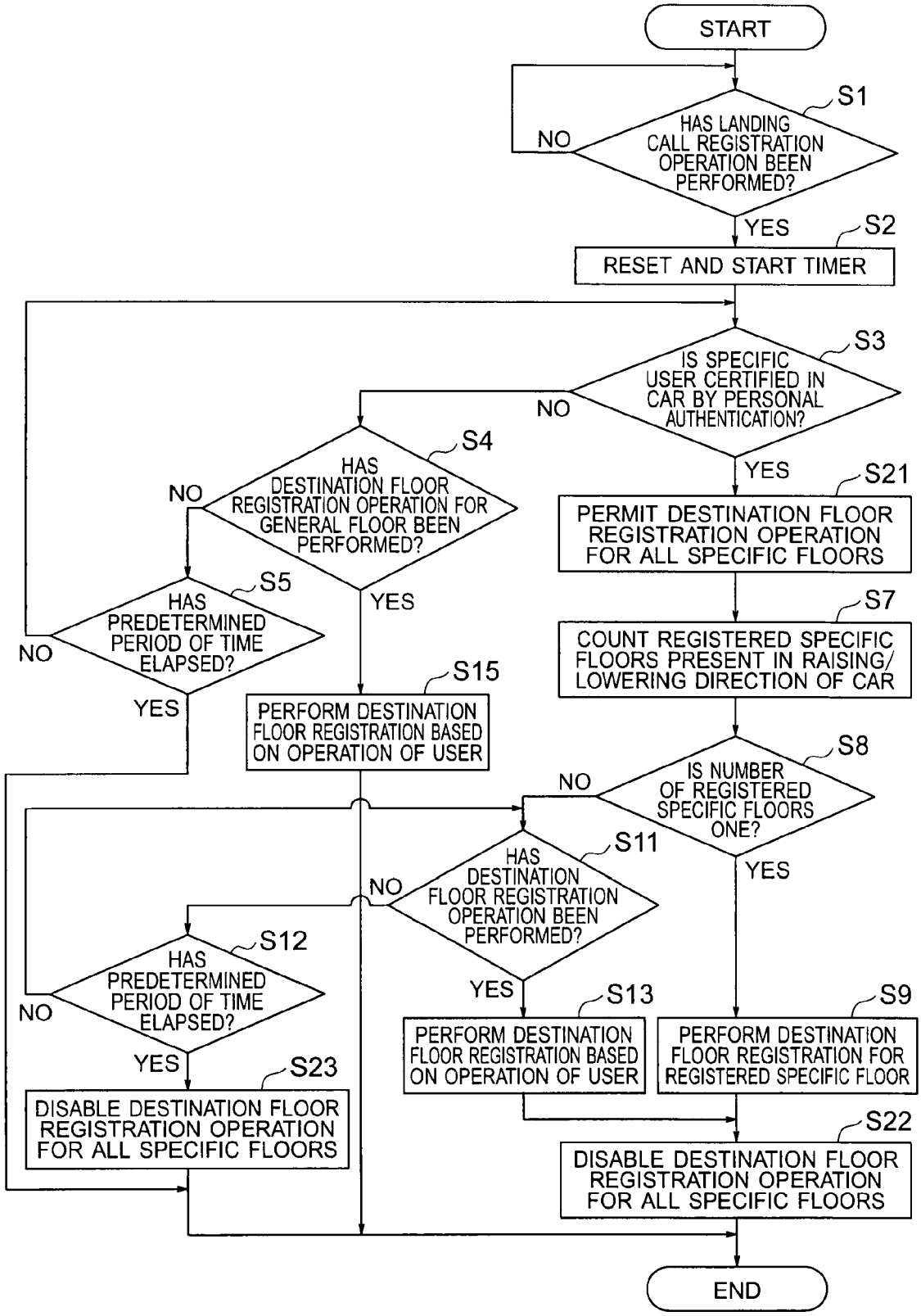
[FIG. 4] A flowchart illustrating an operation of an elevator controller according to a second embodiment of the present invention.

FIG. 4 is a flowchart illustrating the operation of the elevator controller 4 according to the second embodiment. Upon reception of the registered floor information of the specific user, the elevator controller 4 permits the destination floor registration operation for all the specific floors, which is performed through the intra-car operation panel 5 (Step S21). Then, when the elevator controller 4 verifies that the destination floor registration for the car 3 has been performed or the predetermined period of time has elapsed from the start of the timer, the elevator controller 4 disables the destination floor registration operation performed through the intra-car operation panel 5 (Steps S22 and S23). The other operation is the same as that of the first embodiment.

The elevator system as described above permits the destination floor registration operation for all the specific floor, which is performed by the specific user through the intra-car operation panel 5, and hence the specific user can travel to the specific floor other than the registered specific floor which is registered in advance by the specific user.

The elevator controller 4 according to the first and second embodiments counts the registered specific floors present in the raising/lowering direction of the car 3, and performs the destination floor registration with the registered specific floor being the destination floor of the car 3 if the number of the counted registered specific floors is one. However, the operation control section may count the registered specific floors and registered general floors present in the raising/lowering direction of the car, and may perform the destination floor registration with the registered floor being the destination floor of the car if the number of the counted registered floors is one. Specifically, the operation control section may perform the destination floor registration with the general floor present in the raising/lowering direction of the car being the destination floor of the car.

Third Embodiment

Next, a third embodiment of the present invention is described. The call registration control section 4*e* of the first and second embodiments permits the landing call registration operation performed by the user through each of the landing operation panels 7 on all the car stop floors, but the call registration control section 4*e* according to the second embodiment disables in advance the landing call registration operation performed by the user through the landing operation panel 7 on the general floor. The call registration control section 4*e* permits the landing call registration operation performed by the user through the landing operation panel 7 on the general floor based on the contents of the operation of the car 3, which are judged by the control content judging section 4*d*. The other structure is the same as that of the first embodiment or the second embodiment.

Figure 5:
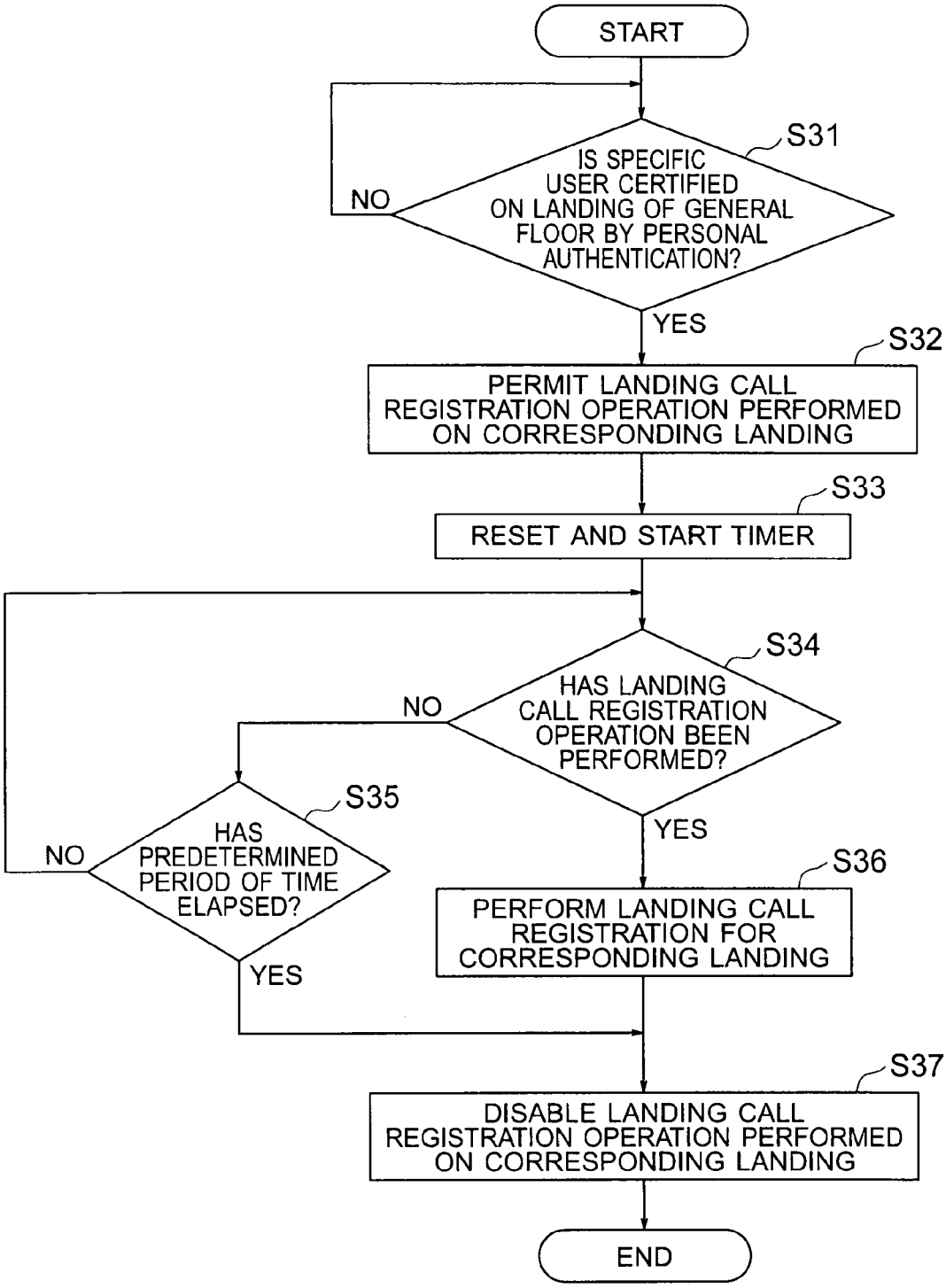
[FIG. 5] A flowchart illustrating an operation of an elevator controller according to a third embodiment of the present invention.

Next, the operation is described. The operation of the elevator controller 4 related to the personal authentication of the specific user on the landing is described. FIG. 5 is a flowchart illustrating the operation of the elevator controller 4 according to the third embodiment in response to the landing call registration operation. First, the elevator controller 4 verifies whether or not the specific user has been certified by the personal authentication on the landing of the general floor and waits until the specific user is certified by the personal authentication (Step S31). Upon verification of the personal authentication of the specific user, the elevator controller 4 permits the call registration operation performed by the user through the landing operation panel 7 on the corresponding landing (Step S32), and resets and starts the timer (Step S33).

Then, the elevator controller 4 verifies whether or not the landing call registration operation has been performed by the user through the corresponding landing operation panel 7 (Step S34), and verifies whether or not the predetermined period of time has elapsed from the start of the timer (Step S35). At this time, when the landing call registration operation is performed by the user through the corresponding landing operation panel 7, the elevator controller 4 performs the landing call registration for the corresponding landing (Step S36) and sets to disable the landing call registration operation performed through the corresponding landing operation panel 7 (Step S37). In the manner as described above, the operation of the elevator controller 4 related to the personal authentication of the specific user on the landing is terminated.

When the elevator controller 4 verifies that the predetermined period of time has elapsed while verifying whether or not the landing call registration operation has been performed through the corresponding landing operation panel 7 or whether or not the predetermined period of time has elapsed from the start of the timer (direction YES from Step S35), the elevator controller 4 sets to disable the landing call registration operation performed through the corresponding landing operation panel 7 (Step S37). In the manner as described above, the operation of the elevator controller 4 related to the personal authentication of the specific user on the landing is terminated.

In the elevator system as described above, the landing call registration operation performed through the landing operation panel 7 located on the general floor is disabled in advance. Then, upon personal authentication of the specific user, the landing call registration operation performed through the landing operation panel 7 located on the general floor is permitted. Therefore, the use of the elevator 2 by the general user is inhibited to improve the security of the elevator 2.

Fourth Embodiment

Next, a fourth embodiment of the present invention is described. In response to the personal authentication of the specific user on the landing by the personal authentication device 9, the control content judging section 4*d* of the fourth embodiment judges, based on the building floor structure information, in which of an upward direction and a downward direction from the landing floor specified by the personal authentication device 9 all the registered floors based on the registered floor information corresponding to the specific user are present. Then, when the control content judging section 4*d* verifies that all the registered floors are present in only one of the upward direction and the downward direction from the specified landing floor, the control content judging section 4*d* performs the landing call registration with the traveling direction of the car 3 from the specified landing floor being the direction in which the registered floors are present. The other structure is the same as that of the third embodiment.

Figure 6:
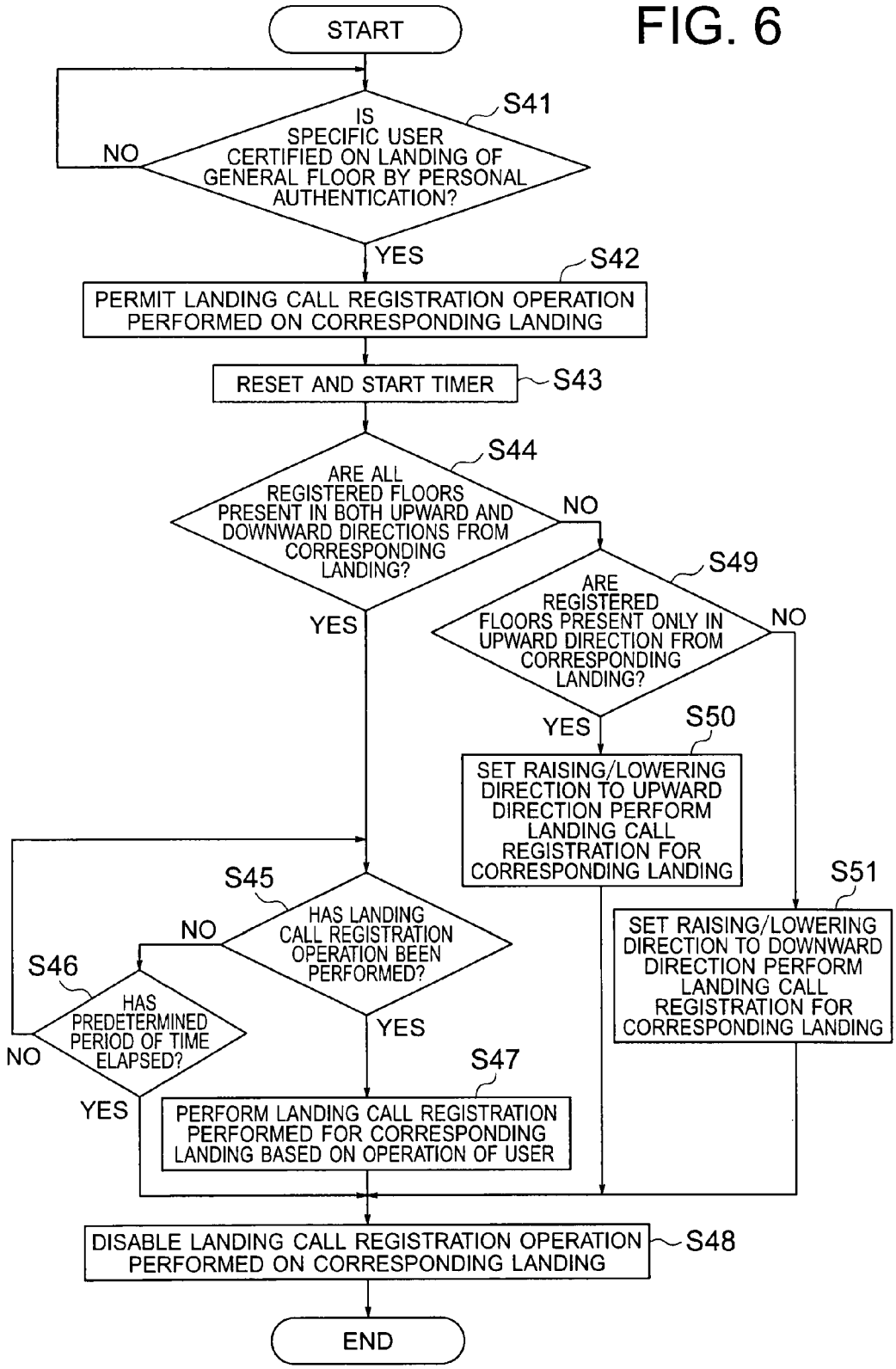
[FIG. 6] A flowchart illustrating a part of an operation of an elevator controller according to a fourth embodiment of the present invention.

Next, the operation is described. Here, similarly to the third embodiment, the operation of the elevator controller 4 related to the personal authentication of the specific user on the landing is described. FIG. 6 is a flowchart illustrating a part of the operation of the elevator controller 4 according to the fourth embodiment. First, the elevator controller 4 verifies whether or not the specific user has been certified by the personal authentication on the landing of the general floor and waits until the specific user is certified by the personal authentication (Step S41). Upon reception of the registered floor information, the elevator controller 4 permits the call registration operation performed by the user through the landing operation panel 7 on the corresponding landing (Step S42), and resets and starts the timer (Step S43).

Then, the elevator controller 4 verifies whether or not the registered floors corresponding to the specific user certified by the personal authentication are present in both the upward direction and the downward direction from the corresponding landing (Step S44). When the registered floors are present in both the upward direction and the downward direction (direction YES from Step S44), the elevator controller 4 verifies whether or not the landing call registration operation has been performed by the user through the corresponding landing operation panel 7 (Step S45), and verifies whether or not the predetermined period of time has elapsed from the start of the timer (Step S46). At this time, when the landing call registration operation is performed by the user through the corresponding landing operation panel 7 (direction YES from Step S45, the elevator controller 4 performs the landing call registration for the corresponding landing (Step S47) and sets to disable the landing call registration operation performed through the corresponding landing operation panel 7 (Step S48). In the manner as described above, the operation of the elevator controller 4 related to the personal authentication of the specific user on the landing is terminated.

When the elevator controller 4 verifies that the predetermined period of time has elapsed while verifying whether or not the landing call registration operation has been performed through the corresponding landing operation panel 7 or whether or not the predetermined period of time has elapsed from the start of the timer (direction YES from Step S46), the elevator controller 4 sets to disable the landing call registration operation performed through the corresponding landing operation panel 7 (Step S48). In the manner as described above, the operation of the elevator controller 4 related to the personal authentication of the specific user on the landing is terminated.

On the other hand, when the registered floors are present in only one of the upward and downward directions from the corresponding landing (direction NO from Step S44), the elevator controller 4 verifies whether or not the registered floors are present only in the upward direction from the corresponding landing floor (Step S49). When the registered floors are present only in the upward direction (direction YES from Step S49), the elevator controller 4 performs a traveling direction registration with the raising/lowering direction of the car 3 being upward from the corresponding landing and the landing call registration for the corresponding landing (Step S50). Then, the elevator controller 4 sets to disable the landing call registration operation performed through the corresponding landing operation panel 7 (Step S48). In the manner described above, the operation of the elevator controller 4 related to the personal authentication of the specific user on the landing is terminated.

When the registered floors are not present only in the upward direction from the corresponding landing, specifically, the registered floors are present only in the downward direction (direction NO from Step S49), the elevator controller 4 performs the traveling direction registration with the raising/lowering direction of the car 3 from the corresponding landing being downward and the landing call registration for the corresponding landing (Step S51). Then, the elevator controller 4 sets to disable the landing call registration operation performed through the corresponding landing operation panel 7 (Step S48). In the manner described above, the operation of the elevator controller 4 related to the personal authentication of the specific user on the landing is terminated.

Figure 7:
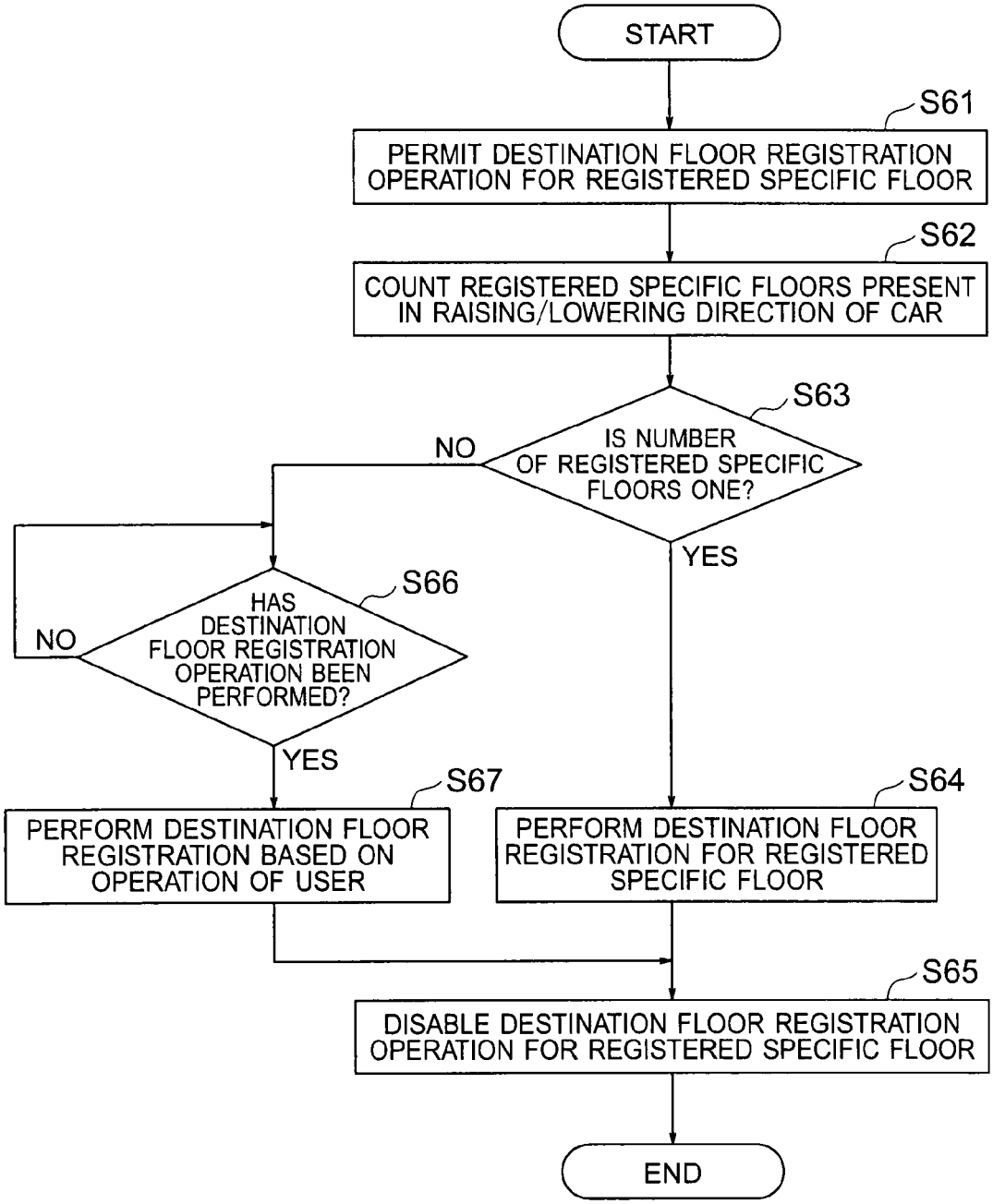
[FIG. 7] A flowchart illustrating the part of the operation of the elevator controller according to the fourth embodiment of the present invention.

Next, the operation of the elevator controller 4 when the car 3 arrives on the landing after the landing call registration is described. FIG. 7 is a flowchart illustrating a part of the operation of the elevator controller 4 according to the fourth embodiment. First, when the elevator controller 4 detects that the car 3 arrives at the corresponding landing and the door is opened, the elevator controller 4 permits the destination floor registration operation performed through the intra-car operation panel 5 for the registered specific floor included in the registered floor information of the specific user (Step S61) and counts the registered specific floors present in the raising/lowering direction of the car 3 (Step S62).

Then, the elevator controller 4 verifies whether or not the number of the counted registered specific floors is one (Step S63). When the number of the counted registered specific floors is one, the elevator controller 4 performs the destination floor registration with the registered specific floor being the destination floor of the car 3 (Step S64). Then, the elevator controller 4 disables the destination floor registration operation for the registered specific floor, which is performed through the intra-car operation panel 5 (Step S65), closes the door of the car 3, and starts the operation of the car 3 to the registered destination floor. In the manner described above, the operation of the elevator controller 4 when the car 3 arrives at the landing after the landing call registration is terminated.

On the other hand, if the number of the counted registered specific floors is not one when the registered specific floors present in the direction in which the car 3 is to be raised or lowered is counted (direction NO from Step S63), the elevator controller 4 verifies whether or not the destination floor registration operation has been performed by the specific user through the intra-car operation panel 5 and waits until the destination floor registration operation is performed (Step S66). When the destination floor registration operation is performed, the elevator controller 4 performs the destination floor registration based on the destination floor registration operation performed by the user through the intra-car operation panel 5 (Step S67), disables the destination floor registration operation for the registered specific floor, which is performed through the intra-car operation panel 5 (Step S65), closes the door of the car 3, and starts the operation of the car 3 to the registered destination floor. In the manner as described above, the operation of the elevator controller 4 when the car 3 arrives at the landing after the landing call registration is terminated.

In the elevator system as described above, upon personal authentication of the specific user on the landing, the elevator controller 4 performs the traveling direction registration with the direction in which the registered floors are present being the traveling direction of the car 3 and the landing call registration for the corresponding registered floor if the registered floors corresponding to the specific user are present in only one of the upward direction and the downward direction of the corresponding landing. Therefore, the landing call registration operation performed by the specific user is no longer required. As a result, the convenience for the specific user can be improved.

When the traveling direction of the car 3 from the corresponding landing is registered, the destination floor registration with the registered specific floor being the destination floor of the car 3 is performed if the number of the registered specific floors present in the traveling direction of the car 3 is one in the registered specific floors corresponding to the specific user. Therefore, besides the landing call registration operation performed by the specific user, the destination floor registration operation is no longer required. As a result, the convenience for the specific user can be further improved.

The elevator controller 4 of the fourth embodiment performs the destination floor registration with the registered specific floor being the destination floor of the car 3 if the number of the registered specific floors present in the traveling direction of the car 3 is one in the registered specific floors corresponding to the specific user, but the elevator controller 4 may also perform the destination floor registration with the registered floor being the destination floor of the car 3 if the number of the registered floors present in the traveling direction of the car 3 is one in the registered floors (registered specific floors and registered general floors) corresponding to the specific user.

Fifth Embodiment

Figure 8:
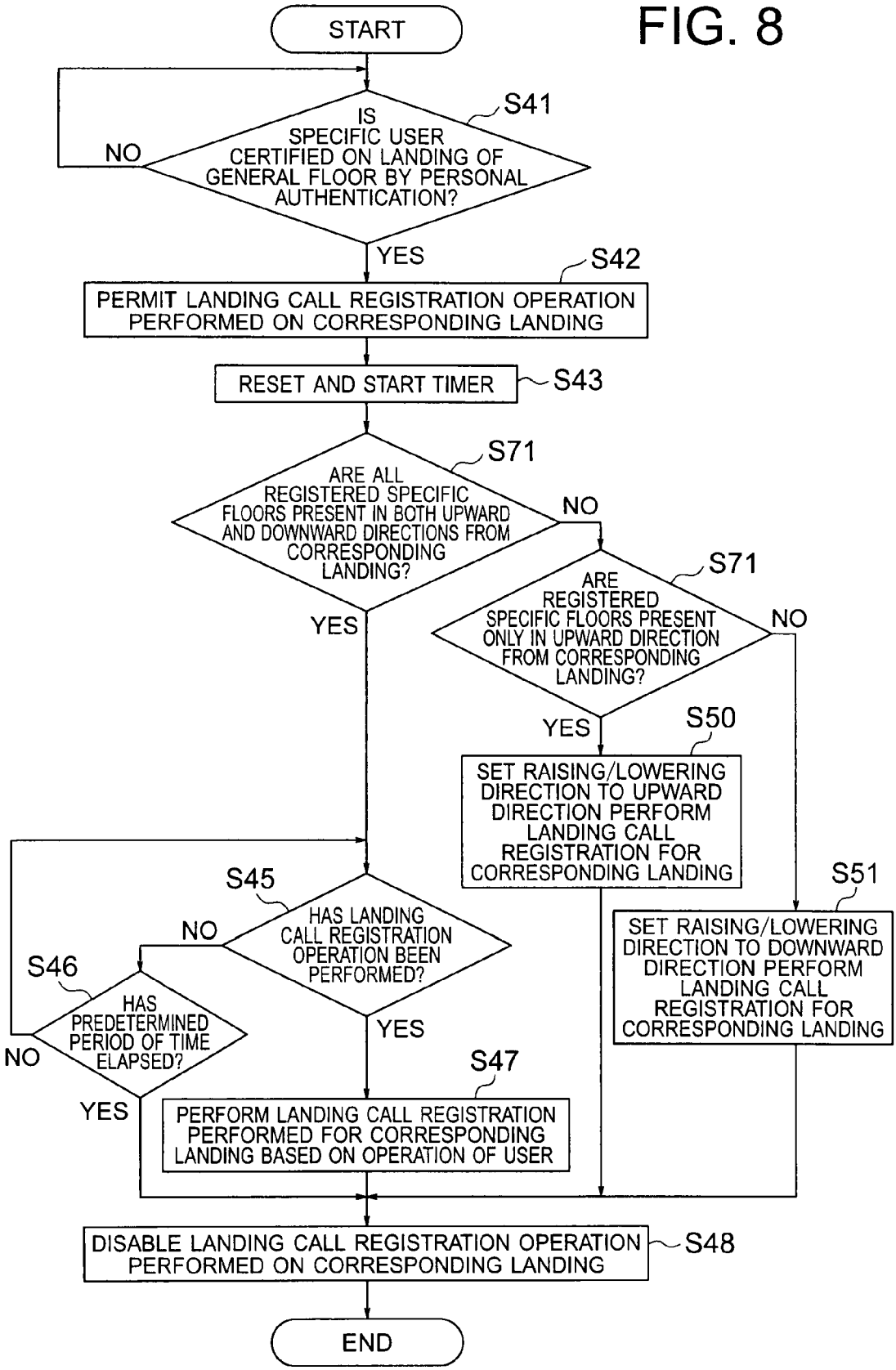
[FIG. 8] A flowchart illustrating an operation of an elevator controller according to a fifth embodiment of the present invention.

The elevator controller 4 according to the fourth embodiment judges whether or not all the registered floors are present in both the upward direction and the downward direction from the corresponding landing. Then, if all the registered floors are present in only one of the upward direction and the downward direction from the corresponding landing, the elevator controller judges whether or not the registered floors are present only in the upward direction from the corresponding landing (Steps S44 and S49 illustrated in FIG. 6). However, as illustrated in FIG. 8, the elevator controller 4 may also judge whether or not all the registered specific floors are present in both the upward direction and the downward direction from the corresponding landing. If all the registered specific floors are present only in one of the upward direction and the downward direction from the corresponding landing, the elevator controller 4 may judge whether or not the registered specific floors are present only in the upward direction from the corresponding landing (Steps S71 and S72).

Sixth Embodiment

Figure 9:
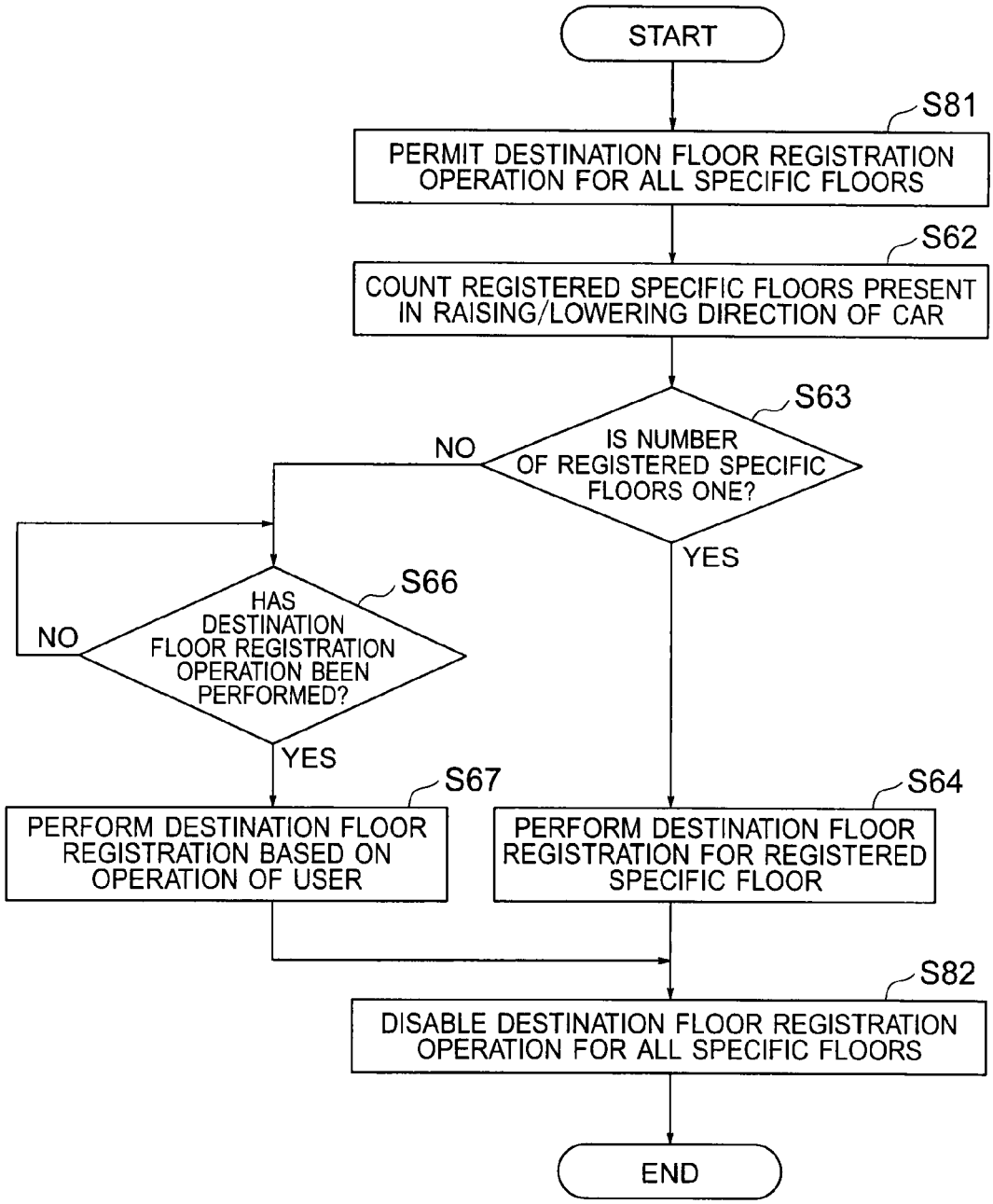
[FIG. 9] A flowchart illustrating an operation of an elevator controller according to a sixth embodiment of the present invention.

Further, the elevator controller 4 according to the fourth embodiment permits the destination floor registration operation for the registered specific floor corresponding to the specific user, which is performed through the intra-car operation panel 5, upon detection of the door opening of the car 3 (Steps S61 and S65 illustrated in FIG. 7), but the elevator controller 4 may permit the destination floor registration operation for all the specific floors, which is performed through the intra-car operation panel 5, upon detection of the door opening of the car 3, as illustrated in FIG. 9 (Steps S81 and S82).

Seventh Embodiment

Figure 10:
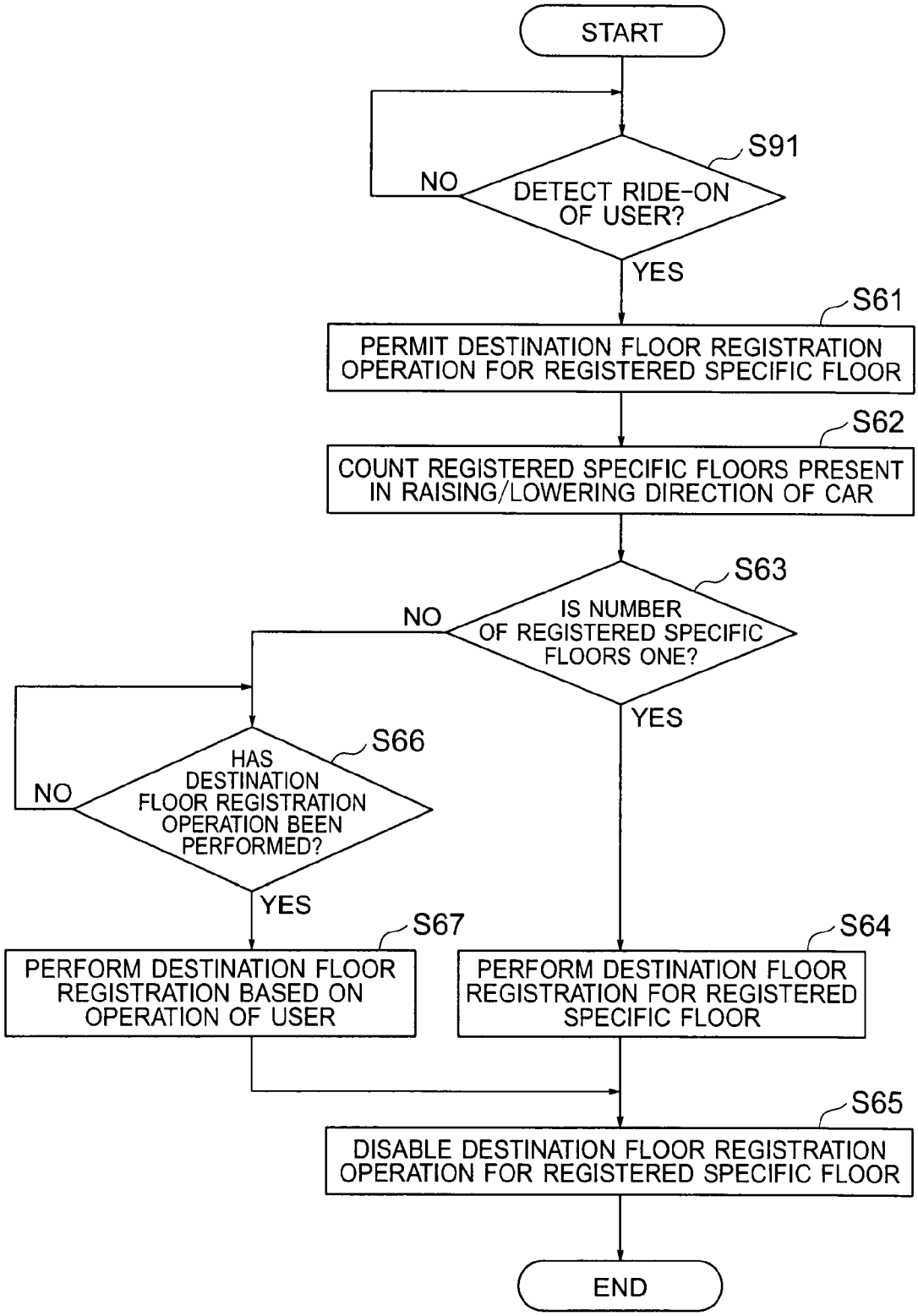
[FIG. 10] A flowchart illustrating an operation of an elevator controller according to a seventh embodiment of the present invention.

Further, the elevator controller 4 according to the fourth embodiment permits the destination floor registration operation for the registered specific floor, which is performed by the user, immediately after performing the landing call registration. As illustrated in FIG. 10, however, the elevator controller 4 may verify whether or not the ride of the user on the car 3 is detected after performing the landing call registration (Step S91), wait until the detection of the ride-on of the user, and perform the operation of the elevator controller 4 according to the fourth embodiment as illustrated in FIG. 7 in response to the detection of the ride-on of the user.

Eighth Embodiment

Figure 11:
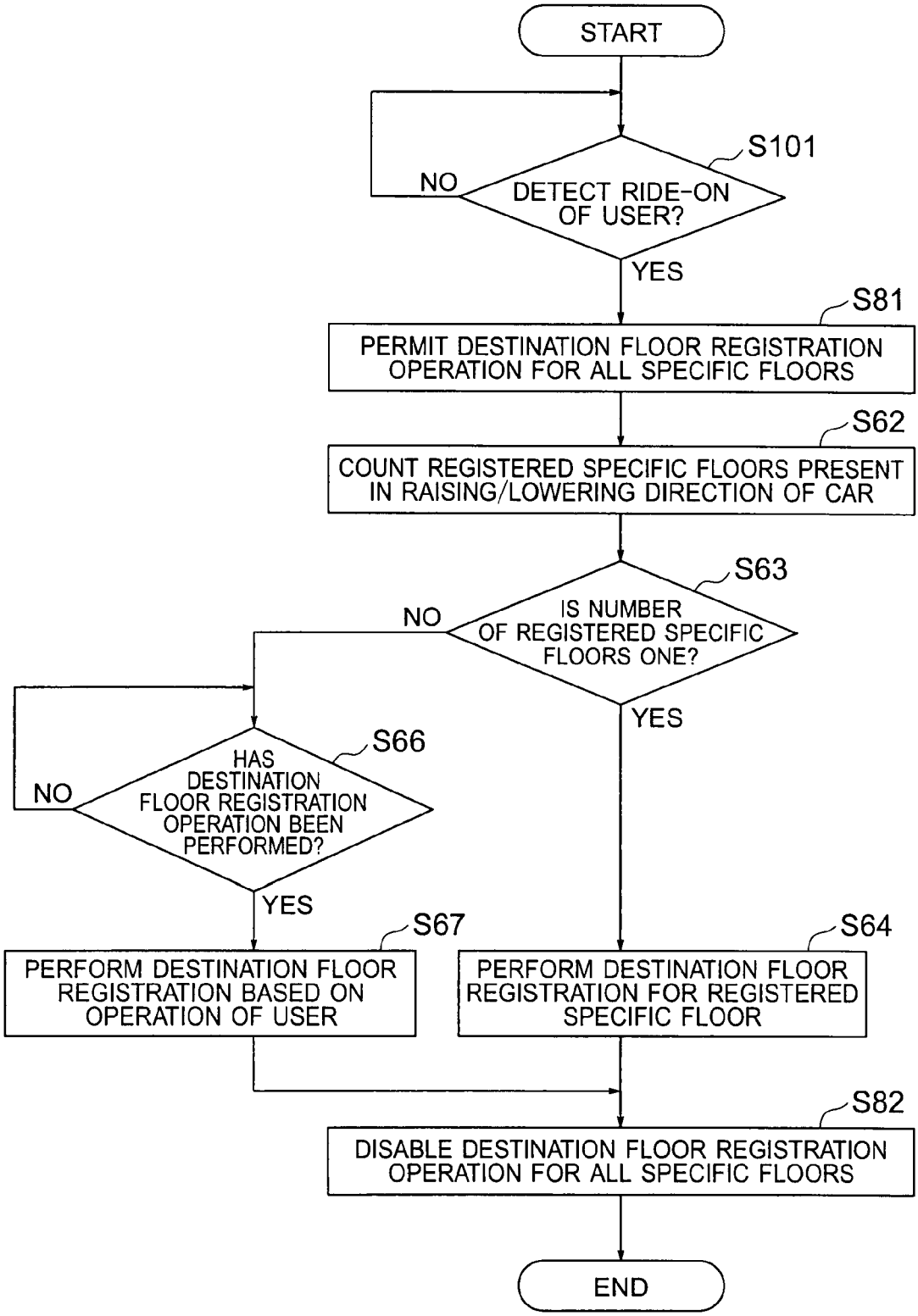
[FIG. 11] A flowchart illustrating an operation of an elevator controller according to an eighth embodiment of the present invention.

Further, the elevator controller 4 according to the sixth embodiment permits the destination floor registration operation for all the specific floors, which is performed by the user, immediately after performing the landing call registration. As illustrated in FIG. 11, however, the elevator controller 4 may verify whether or not the ride of the user on the car 3 is detected after performing the landing call registration (Step S101), wait until the detection of the ride-on of the user, and perform the operation of the elevator controller 4 according to the sixth embodiment as illustrated in FIG. 9 in response to the detection of the ride-on of the user.

The elevator controller 4 of the eighth embodiment performs the destination floor registration with the registered specific floor being the destination floor of the car 3 if the number of the registered specific floors present in the traveling direction of the car 3 is one in the registered specific floors corresponding to the specific user, but the elevator controller 4 may also perform the destination floor registration with the registered floor being the destination floor of the car 3 if the number of the registered floors present in the traveling direction of the car 3 is one in the registered floors (registered specific floors and registered general floors) corresponding to the specific user.

Ninth Embodiment

Next, a ninth embodiment of the present invention is described. When the landing call registration operation is performed by the user through the landing operation panel 7 located on the landing, the control content judging section 4*d* of the ninth embodiment judges based on the building floor structure information whether or not the landing floor on which the operated landing operation panel 7 is located is the specific floor. Then, when the control content judging section 4*d* judges that the landing floor on which the operated landing operation panel 7 is located is the specific floor, the control content judging section 4*d* counts the general floors present in the traveling direction of the car 3 in response to the landing call registration operation based on the building floor structure information. If the number of the counted general floors is one, the control content judging section 4*d* performs the destination floor registration with the general floor being the destination floor of the car 3. The other structure is the same as that of any one of the first to eighth embodiments.

Figure 12:
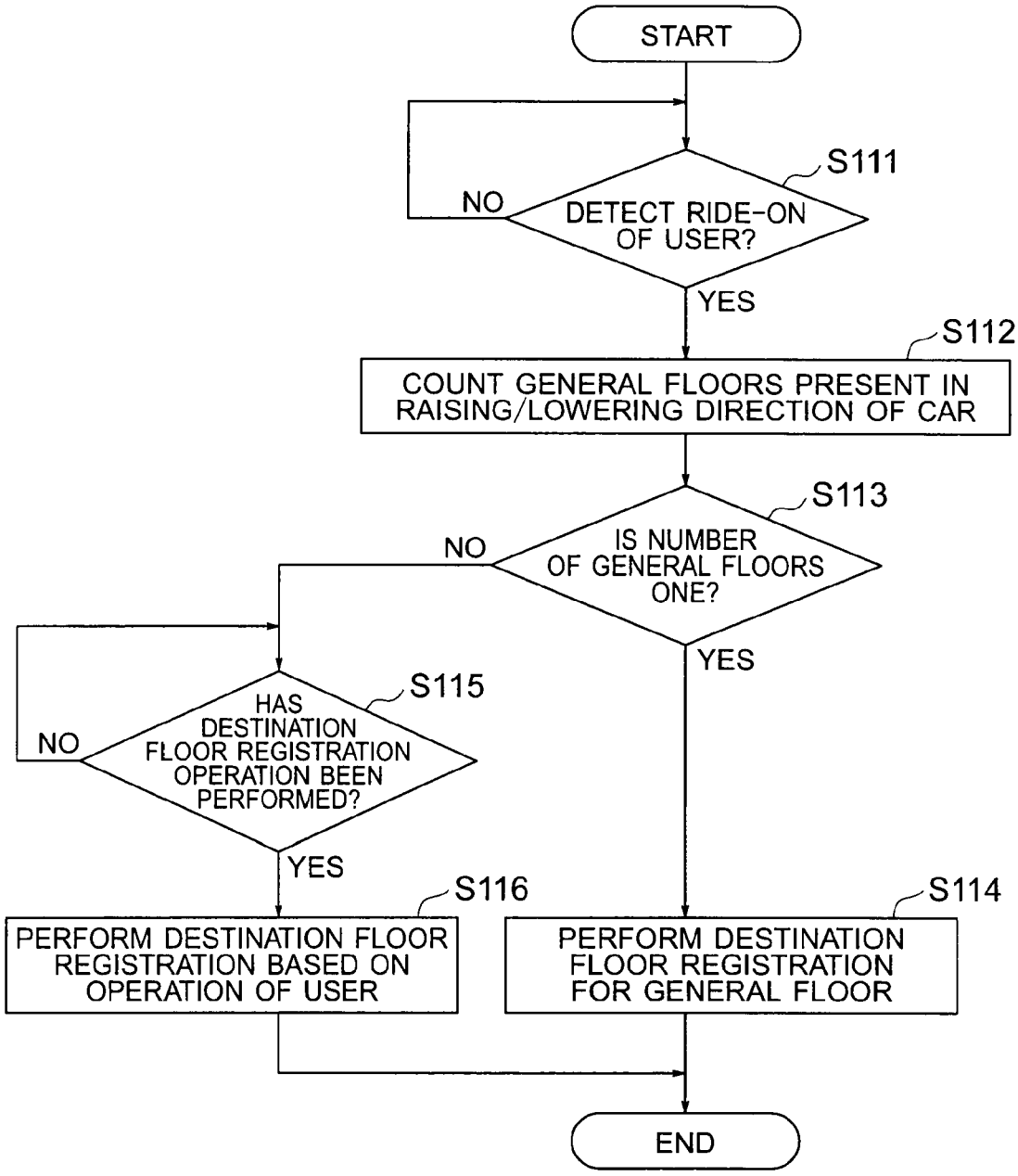
[FIG. 12] A flowchart illustrating an operation of an elevator controller according to a ninth embodiment of the present invention.

Next, the operation in response to the landing call registration operation performed by the user through the landing operation panel 7 located on the specific floor is described. FIG. 12 is a flowchart illustrating the operation of the elevator controller 4 according to the ninth embodiment. First, when the landing call registration operation is performed by the user through the landing operation panel 7 located on the specific floor, the elevator controller 4 raises/lowers the car 3 to the landing to cause the door to open. Then, the elevator controller 4 verifies whether or not the ride of the user on the car 3 has been detected (Step S111), and waits until the ride-on of the user is detected.

Then, upon detection of the ride-on of the user, the elevator controller 4 counts the general floors present in the traveling direction of the car 3 according to the landing call registration operation (Step S112), and verifies whether or not the number of the counted general floors is one (Step S113). When the number of the general floors is one, the elevator controller 4 performs the destination floor registration with the general floor being the destination floor of the car 3 (Step S114) and starts raising/lowering the car 3. In the manner as described above, the operation of the elevator controller 4 in response to the landing call registration operation performed through the landing operation panel 7 on the specific floor is terminated.

On the other hand, when the number of the general floors is not one (direction NO from Step S113), the elevator controller 4 verifies whether or not the destination floor registration operation has been performed by the user through the intra-car operation panel 5 (Step S115) and waits until the destination floor registration operation is performed. Then, when the destination floor registration operation is performed by the user, the elevator controller 4 performs the destination floor registration according to the operation (Step S116) and starts raising/lowering the car 3. In the manner described above, the operation of the elevator controller 4 in response to the landing call registration operation performed through the landing operation panel 7 located on the specific floor is terminated.

In the elevator system as described above, when the landing operation panel 7 located on the specific floor is operated by the user, the landing call registration performed on the landing floor and the destination floor registration for the general floor are performed by the elevator controller 4. Therefore, the user can travel to the general floor by a simple operation for the user. As a result, the convenience for the user can be further improved.

The elevator controller 4 of the ninth embodiment performs the destination floor registration of the car 3 immediately after the landing call registration operation is performed on the specific floor, but the operation control section may perform the destination floor registration of the car 3 after the landing call registration operation is performed on the specific floor and then the ride of the user on the car is detected on the landing floor.

Tenth Embodiment

Next, a tenth embodiment of the present invention is described. In the elevator controller 4, information of an operating condition indicating whether or not to implement the elevator call registrations, specifically, the landing call registration and the destination floor registration, in response to the personal authentication of the specific user is preset. The operating condition is settable for at least any one of the personal identification information, the landing floor, and a time zone. The control content judging section 4*d*, implements the automatic registration for the landing call registration and the destination floor registration based on the operating condition.

Here, an example of the operating condition set in the control content judging section 4*d* is described. In the control content judging section 4*d*, the operating condition (effectiveness of the automatic registration) is set in association with a specific time zone as illustrated in FIG. 13. The specific time zone includes peak time zones such as a school commute time zone, a work commute time zone, a going-home time zone from work, a going-home time zone from school, and the like. Then, the control content judging section 4*d* implements the automatic registration for the landing call registration and the destination floor registration only in the specific time zone for which the automatic registration is set effective.

As another example of the operating condition set for the control content judging section 4*d*, the operating condition (effectiveness of the automatic registration) is registered in association with a room number and a family number corresponding to the personal identification information in the control content judging section 4*d* as illustrated in FIG. 14. In this case, the family number, for which the automatic registration is to be performed, is a number corresponding to a disabled user or an elderly user. The control content judging section 4*d* implements the automatic registration for the landing call registration and the destination floor registration in response to the ride-on of the user having the family number for which the automatic registration is set effective.

Further, as a further example of the operating condition set for the control content judging section 4*d*, the operating condition (effectiveness of the automatic registration) is set in association with information of the general floors in the control content judging section 4*d* as illustrated in FIG. 15. After the personal authentication of the specific user on the landing floor (ground floor; entrance floor) for which the automatic registration is set effective, the control content judging section 4*d* implements the automatic registration for the landing call registration and the destination floor registration. The operating conditions illustrated in FIGS. 13 to 15 may be set alone or in combination in the control content judging section 4*d*. The other structure and operation are the same as those of any one of the first to ninth embodiments.

Whether or not the automatic registration for the landing call registration and the destination floor registration can be implemented can be determined based on the operating condition in the elevator system as described above, and hence elevator service corresponding to a usage pattern of the building 1 and a life style of each of the specific users can be provided for the specific user.

The elevator system of the present invention may be used for a building with a built-in visitor management system for managing the users visiting/leaving the building. Specifically, even if all the floors of the building are the specific floors, the elevator system of the present invention can be used.

Moreover, the elevator controller 4 controls the running of the single elevator 2 in the first to tenth embodiments, but the number of the elevators 2 is not limited to this example. The elevator controller 4 may control a group of a plurality of the elevators 2 in response to an operation control signal from the remote controller 10.

Further, the system includes the plurality of the elevators 2 in the first to tenth embodiments, but the number of the elevators 2 is not limited to this example. The system may include the single elevator. In this case, the operation control section, the personal authentication section, and the registered information extracting section may be constituted by the same computer.

Further, the personal authentication device 9 and the remote controller 10 are respectively constituted by the different computers in the first to tenth embodiments, but the personal authentication section and the registered information extracting section may be constituted by the same computer.

Further, the elevator controller 4 controls the running of the single elevator 2 in the first to tenth embodiments, but the operation control section may control the plurality of elevators as one group to perform the running control in a group unit.

Further, the ID card reading section is used as the personal identification information reading section of each of the intra-car matching device 6 and the landing matching device 8 in the first to tenth embodiments, but a biometric information reading section for reading biometric information, for example, a fingerprint, a palm print, an iris, and the like of the specific user may be used as the personal identification information reading section.

The invention claimed is:

1. An elevator system used for a building including a plurality of specific floors usable by a specific user acquiring personal identification information in advance, comprising:

an operation control section for controlling an operation of a car;

an intra-car input section provided in the car, to which the personal identification information is input by the specific user;

a personal authentication section for making personal authentication of the specific user based on the personal identification information received from the intra-car input section; and a registered information extracting section capable of being registered with information of a registered specific floor corresponding to the specific floor pre-designated by the specific user as registered floor information in association with the personal identification information, for extracting the registered floor information corresponding to the specific user certified by the personal authentication based on the personal identification information received from the personal authentication section, wherein, upon the personal authentication of the specific user in the car by the personal authentication section while the operation control section causes the car to wait on a landing in response to a landing call registration operation performed on the landing, the operation control section counts the registered specific floors present in a traveling direction of the car according to the landing call registration operation in the registered specific floors based on the registered floor information received from the registered information extracting section, and performs a destination floor registration with the registered specific floor being a destination floor of the car if the number of the counted registered specific floors is one.

2. An elevator system according to claim 1, wherein the operation control section presets to disable a destination floor registration operation for the specific floor, which is performed through a car operation section provided in the car to be operated by a user, and permits the destination floor registration operation for the registered specific floor corresponding to the specific user certified by the personal authentication in response to the personal authentication of the specific user by the personal authentication section.

3. An elevator system according to claim 1, wherein the operation control section presets to disable a destination floor registration operation for the specific floor, which is performed through a car operation section provided in the car to be operated by a user, and permits the destination floor registration operation for all the specific floors in response to the personal authentication of the specific user by the personal authentication section.

4. An elevator system according to claim 1, wherein:

the building further includes at least one general floor usable by a general user in addition to the specific floors;

the registered floor information contains information of a registered general floor corresponding to the general floor pre-designated by the specific user in addition to the information of the registered specific floor; and upon the personal authentication of the specific user in the car by the personal authentication section while the operation control section causes the car to wait on the landing in response to the landing call registration operation performed on the landing, the operation control section counts registered floors present in the traveling direction of the car according to the landing call registration operation in the registered floors including the registered specific floors and the registered general floor in the registered floor information received from the registered information extracting section, and performs the destination floor registration with the registered floor being the destination floor of the car if the number of the counted registered floors is one.

5. An elevator system according to claim 1, wherein:

the building further includes at least one general floor usable by a general user in addition to the specific floors;

the elevator system further includes a landing input section provided on the landing, to which the personal identification information is input by the specific user; and the operation control section presets to disable the landing call registration operation through a landing call operation section provided on a landing of the general floor of the building, and permits the landing call registration operation performed through the landing call operation section provided on the same landing as that provided with the landing input section upon the personal authentication of the specific user made by the personal authentication section based on the personal identification information received from the landing input section.

6. An elevator system according to claim 1, wherein:

the building further includes at least one general floor usable by a general user in addition to the specific floors; and the operation control section counts the general floors present in a raising/lowering direction of the car according to the landing call registration operation in response to the landing call registration operation performed through the landing call operation section provided on the landing of the specific floor, and performs the destination floor registration with the general floor being the destination floor of the car if the number of the counted general floors is one.

7. An elevator system according to claim 1, wherein:

information of an operating condition indicating whether or not to implement the destination floor registration in response to the personal authentication of the specific user made by the personal authentication section is settable in the operation control section, the operating condition being a condition settable for at least any one of the personal identification information, a landing floor and a time zone; and the operation control section performs the destination floor registration based on the operating condition in response to the personal authentication of the specific user by the personal authentication section.

8. An elevator system used for a building including a plurality of specific floors usable by a specific user acquiring personal identification information in advance, comprising:

an operation control section for controlling an operation of a car;

a landing input section provided on each of a plurality of landings, to which the personal identification information is input by the specific user;

a personal authentication section for making personal authentication of the specific user and specifying a landing floor at which the personal identification information is input based on the personal identification information received from the landing input section; and a registered information extracting section capable of being registered with information of a registered specific floor corresponding to the specific floor pre-designated by the specific user as registered floor information in association with the personal identification information, for extracting the registered floor information corresponding to the specific user certified by the personal authentication based on the personal identification information received from the personal authentication section, wherein, upon the personal authentication of the specific user on the landing by the personal authentication section, the operation control section judges in which of an upward direction and a downward direction from the landing floor specified by the personal authentication section all the registered specific floors based on the registered floor information received from the personal authentication section are present, and performs a landing call registration with a traveling direction of the car from the specified landing floor being the direction in which the registered specific floors are present if the all the registered specific floors are present in only one of the upward direction and the downward direction.

9. An elevator system according to claim 8, wherein, upon the landing call registration in response to the personal authentication of the specific user by the personal authentication section, the operation control section counts the registered specific floors present in the traveling direction of the car in the registered specific floors corresponding to the specific user certified by the personal authentication, and performs a destination floor registration with the registered specific floor being a destination floor of the car if the number of the counted registered specific floors is one.

10. An elevator system according to claim 8, wherein the operation control section monitors a ride status of a user in the car, counts the registered specific floors present in the traveling direction of the car in the registered floors corresponding to the specific user certified by the personal authentication upon detection of a ride of the user on the car, and performs a destination floor registration with the registered specific floor being a destination floor of the car if the number of the counted registered specific floors is one.

11. An elevator system according to claim 8, wherein the operation control section presets to disable a destination floor registration operation for the specific floor, which is performed through a car operation section provided in the car to be operated by a user, monitors a ride status of the user in the car, and permits the destination floor registration operation for the registered specific floor corresponding to the specific user certified by the personal authentication upon detection of a ride of the user on the car.

12. An elevator system according to claim 8, wherein the operation control section presets to disable a destination floor registration operation for the specific floor, which is performed through a car operation section provided in the car to be operated by a user, monitors a ride status of the user in the car, and permits the destination floor registration operation for all the specific floors upon detection of a ride of the user on the car.

13. An elevator system according to claim 8, wherein:

information of an operating condition indicating whether or not to implement the landing call registration in response to the personal authentication of the specific user made by the personal authentication section is settable in the operation control section, the operating condition being a condition settable for at least any one of the personal identification information, the landing floor and a time zone; and the operation control section performs the landing call registration based on the operating condition in response to the personal authentication of the specific user by the personal authentication section.

14. An elevator system used for a building including at least one general floor useable by a general user and a plurality of specific floors usable by a specific user acquiring personal identification information in advance, comprising:

an operation control section for controlling an operation of a car;

a landing input section provided on each of a plurality of landings, to which the personal identification information is input by the specific user;

a personal authentication section for making personal authentication of the specific user and specifying a landing floor at which the personal identification information is input based on the personal identification information received from the landing input section; and a registered information extracting section capable of being registered with information of a plurality of registered floors including the general floor pre-designated by the specific user and a registered specific floor corresponding to the specific floor pre-designated by the specific user as registered floor information in association with the personal identification information, for extracting the registered floor information corresponding to the specific user certified by the personal authentication based on the personal identification information received from the personal authentication section, wherein, upon the personal authentication of the specific user on the landing by the personal authentication section, the operation control section judges in which of an upward direction and a downward direction from the landing floor specified by the personal authentication section all the registered floors based on the registered floor information received from the personal authentication section are present, and performs a landing call registration with the direction in which the registered floors are present being a traveling direction of the car from the specified landing floor if the all the registered floors are present in only one of the upward direction and the downward direction.

15. An elevator system according to claim 14, wherein the operation control section presets to disable a landing call registration operation performed through a landing call operation section provided on a landing of the general floor, and permits the landing call registration operation performed through the landing call operation section provided on the same landing as that provided with the landing input section in response to the personal authentication by the personal authentication section.

16. An elevator system according to claim 14, wherein, upon the landing call registration in response to the personal authentication of the specific user by the personal authentication section, the operation control section counts the registered floors present in the traveling direction of the car in the registered floors corresponding to the specific user certified by the personal authentication, and performs a destination floor registration with the registered floor being a destination floor of the car if the number of the counted registered floors is one.

17. An elevator system according to claim 14, wherein the operation control section monitors a ride status of a user in the car, counts the registered floors present in the traveling direction of the car in the registered specific floors corresponding to the specific user certified by the personal authentication upon detection of a ride of the user on the car, and performs a destination floor registration with the registered floor being a destination floor of the car if the number of the counted registered floors is one.

18. An elevator system according to claim 14, wherein the operation control section presets to disable a destination floor registration operation for the specific floor, which is performed through a car operation section provided in the car to be operated by a user, monitors a ride status of the user in the car, and permits the destination floor registration operation for the registered specific floor corresponding to the specific user certified by the personal authentication upon detection of a ride of the user on the car.

19. An elevator system according to claim 14, wherein the operation control section presets to disable a destination floor registration operation for the specific floor, which is performed through a car operation section provided in the car to be operated by a user, monitors a ride status of the user in the car, and permits the destination floor registration operation for all the specific floors upon detection of a ride of the user on the car.

20. An elevator system according to claim 14, wherein:

information of an operating condition indicating whether or not to implement the landing call registration in response to the personal authentication of the specific user made by the personal authentication section is settable in the operation control section, the operating condition being a condition settable for at least any one of the personal identification information, the landing floor and a time zone; and the operation control section performs the landing call registration based on the operating condition in response to the personal authentication of the specific user by the personal authentication section.

* * * * *